United States Patent [19]

Hills

[11] 4,217,750

[45] Aug. 19, 1980

[54] MACHINE FOR TWISTING WIRE STRANDS OF ELECTRIC CABLES

[76] Inventor: Bruce W. Hills, 4 The Point Rd., Woolwich, New South Wales 2110, Australia

[21] Appl. No.: 952,946

[22] Filed: Oct. 20, 1978

[30] Foreign Application Priority Data

Oct. 21, 1977 [AU] Australia ..... PD2151

[51] Int. Cl.[3] ..... H01B 13/02; D02G 1/06

[52] U.S. Cl. ..... 57/293; 57/344

[58] Field of Search ..... 57/293, 294, 344

[56] References Cited

U.S. PATENT DOCUMENTS

| | | | |
|---|---|---|---|
| 2,869,316 | 1/1959 | Lilly | 57/293 X |
| 3,367,097 | 2/1968 | Menasoff | 57/294 |
| 3,507,108 | 4/1970 | Yoshimura et al. | 57/294 |
| 3,593,509 | 7/1971 | Feese et al. | 57/293 |
| 3,645,079 | 2/1972 | Stoebener | 57/294 |
| 3,823,536 | 7/1974 | Vogelsberg et al. | 57/294 |
| 3,884,024 | 5/1975 | Oestreich et al. | 57/294 |
| 3,941,166 | 3/1976 | Maillefer | 57/293 X |

*Primary Examiner*—John Petrakes
*Attorney, Agent, or Firm*—J. Harold Nissen

[57] ABSTRACT

A bunching machine for producing a twisted power cable and comprising a rotatable twisting head and a stationary take-off device through which plural strands of wire are continuously drawn, the twisting head being alternately rotated in opposite directions by switch control driven through step-down gearing from the same reversible motor as the twisting head.

5 Claims, 5 Drawing Figures

19
20
20
19A
37
38

21A
36
21
21
19A
35
V
V
15A
15
13
18
20
38
16
34
9
14
23
15A
6
19A
19
17
9
18
12
11
14
15
32

MACHINE FOR TWISTING WIRE STRANDS OF ELECTRIC CABLES

This invention relates to the production of a length of twisted wire strands subsequently to be used in the formation of electric power cables, and more particularly to those cables provided with an outer insulating covering.

Where such cables are intended for use in the conveying of high tension voltage, such as main voltages, standards are frequently applied requiring a minimum degree of twist of the wire strands. Invariably, no such standards are applied to cables confined to use with low value electric voltages, such as those cables utilized in the automotive industry. Attempts, for cost reduction, have been made to produce electric cables for the latter application wherein the wire strands are not twisted, but the resulting product possesses a non-uniform cross-sectional shape and is extremely difficult to handle if kinking and other undesirable effects are to be avoided.

The twisting of wires, whether or not they include insulated coatings, is presently effected by the use of so-called bunching machines which are available in one of two principal types. A first type of bunching machine includes a rotary platform on which spools of wire stock are rotatably supported in a circular array. The wires from the spools are fed through an overhead orifice through which the resultant twisted wire strands are recovered. Due to the centrifugal force developed in such machines the maximum speed of rotation approximates 600 r.p.m. and because of this speed limitation the linear movement of the twisted strands from the orifice is much slower than the optimum operating speed of a plastics extruder utilized for depositing an outer insulating coating around the twisted wires to form the completed cable. Therefore, it is conventional practice to store the twisted wire upon a take-up spool and by a subsequent operation provide the necessary external coating.

The other general type of bunching machine presently available also comprises a rotary platform on which a take-up spool is centrally mounted to receive via an overhead orifice wire strands from respective stationary spools. With this type of machine, also, discrete operations are necessary for both twisting and coating of the wire strands in the production of an electric cable.

It is the main object of this invention to provide an improved method and means for twisting wire strands for use in the production of an electric cable.

Another object is to provide a machine which will produce at relatively low costs an electrical cable composed of twisted wire strands.

In one general form the invention provides a bunching machine for plural wires continuously drawn therethrough for incorporation in a power cable, said machine comprising a rotatable head through which said wires are passed, power means for rotating said head firstly in one direction and then in the reverse direction, control means for said power means determining the change of direction of rotation of said rotating head, and take-off means for said wires beyond said rotating head to retain twist in said wires.

The invention in a second general form comprises a method of producing a stock of twisted wire from separate lengths of wire drawn off continuously and simultaneously from respective supply sources, and comprising passing said strands through a rotary head and then through take-off means which retain any twist in wires passing therethrough, and rotating said head firstly in one direction and then in the reverse direction to twist together the portion of the wires located between the head and the take-off means, whereby the length of the resulting said stock is composed of successive alternating portions of oppositely handed twists.

The invention will be described in greater detail with reference to the accompanying drawings, in which.

Figure 1:
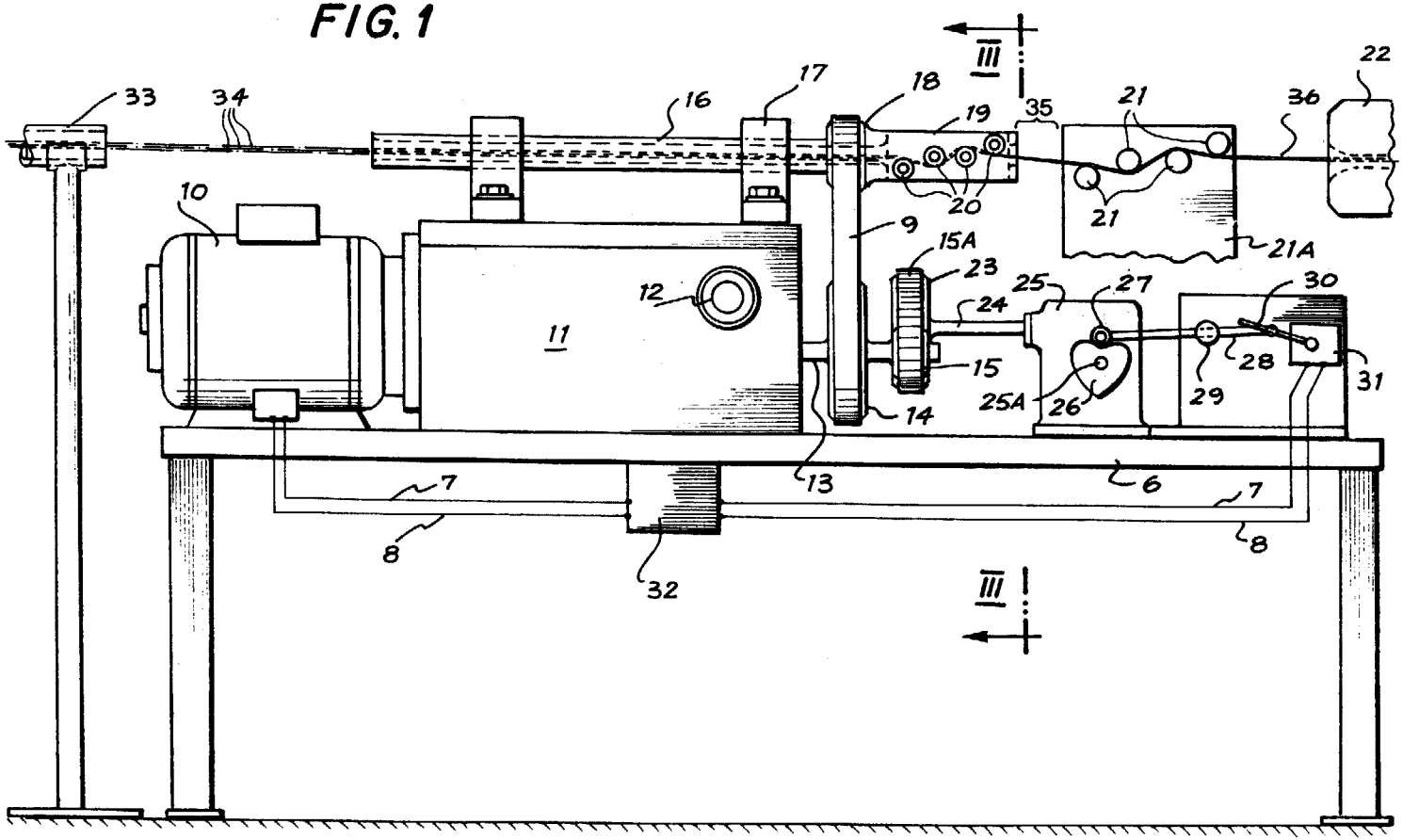
FIG. 1 is a side elevation of a bunching machine constructed according to the invention.
Figure 2:
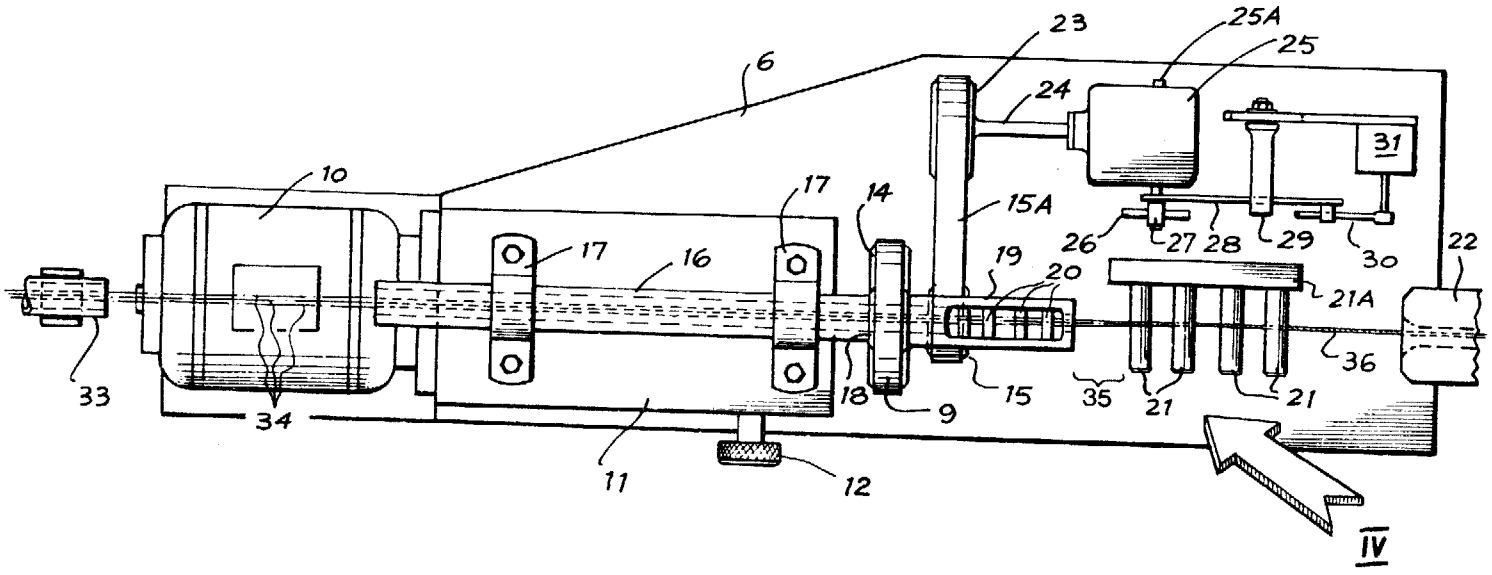
FIG. 2 is a plan view thereof.
Figures 3, 4, 5:
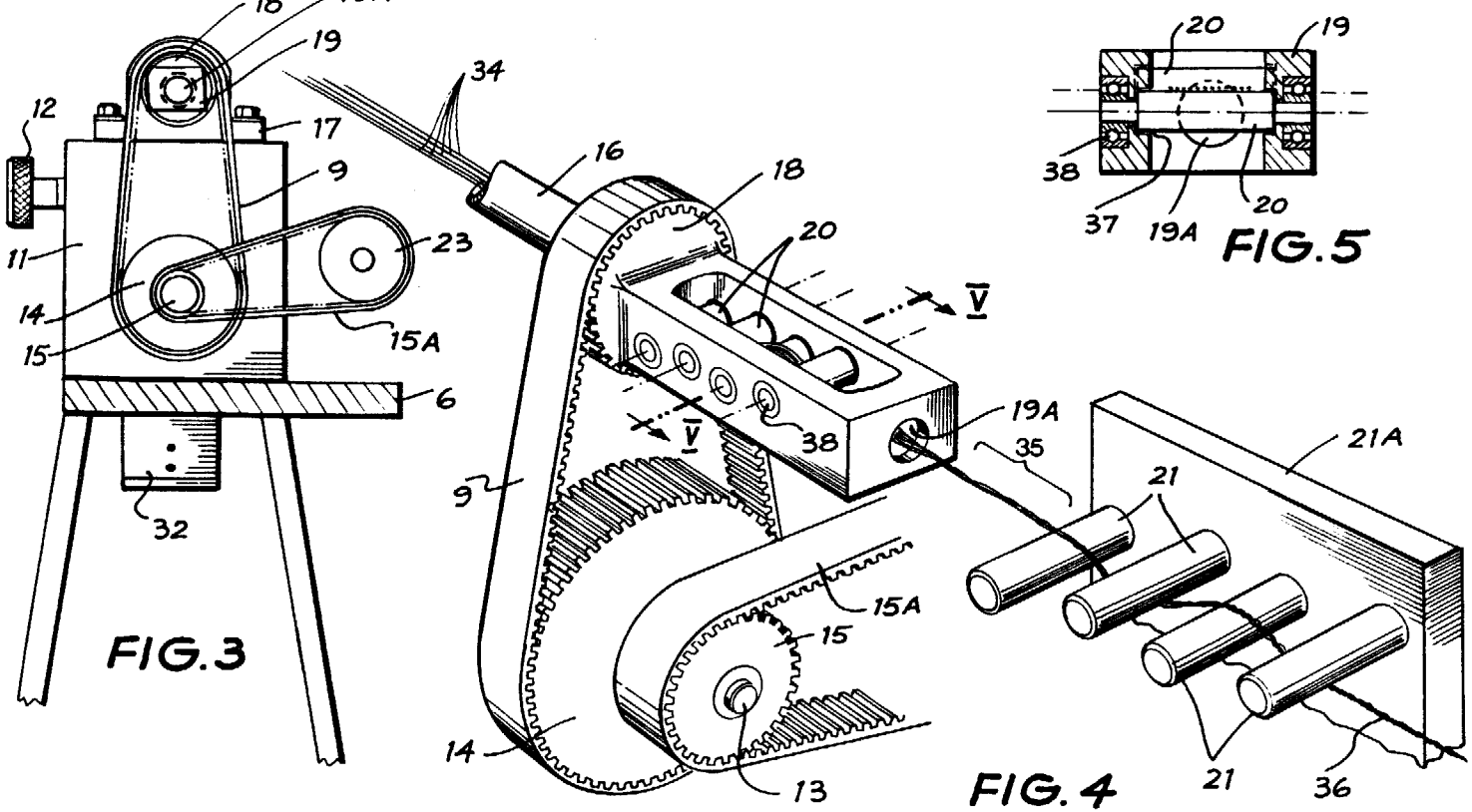
FIG. 3 is an end elevation in section on line III—III of FIG. 1.
FIG. 4 is a part perspective view of the machine viewed at the angle of arrow IV of FIG. 2.
FIG. 5 is a sectional view on line V—V of FIG. 4.

A preferred embodiment of the invention will now be described in which the bunching machine consists of a supporting stand 6 mounting a reversible electric motor 10 coupled to a stepless variodrive unit 11, provided with a hand priming control 12, and a reversing electrical contactor 32 for controlling the power applied to the motor 10 via leads 7 and 8. An electrical two-positional switch 31 is connected by the leads 7 & 8 to the reversing contactor 32 and is wired into the circuitry thereof so that in one position of the switch 31 the motor 10 is energized to rotate in one direction, while in the other position of the switch 31 the motor 10 rotates in the opposite direction. The upper end of the variodrive unit 11 supports a pair of spaced bearings 17 through which rotatably extends a rotating tube 16 to which is keyed a first toothed wheel 18 connected by belt 9 to a second toothed wheel 14 keyed on the output shaft 13 of unit 11. Thus with rotation of the motor 10 the tube 16 also rotates at a speed depending upon the tooth ratio, a step-down ratio as shown, between the two toothed wheels 14 and 18. A rotary roller box 19 is threaded, or otherwise keyed, to a forward end of the tube 16. This box 19 head is hollow with a through bore 19A in register with the bore of tube 16 and mounts a series of transverse gripping rollers 20 rotatable in bearings 38 and alternately offset in the series. As shown by FIG. 5 the ends of each roller 20 are accommodated in recesses 37 to avoid wire jamming between the rollers 20 and roller box 19.

The forward end of the output shaft 13 terminates in a third toothed wheel 15 connected by belt 15A to a companion toothed wheel 23 on an input shaft 24 to a gearbox 25 whose output shaft 25A has a speed reduction in one instance of 1:50. A cam 26 and cam follower 27 connect said output shaft 25A via a lever 28 on a shiftable pivot 29 with an actuator 30 of reversal switch 30. Thus, the number of revolutions of the output shaft 13, and also of the rotating tube 16, in either of the directions of rotation thereof will be governed by oscillation of the output shaft 25A through approximately 360°. The number of revolutions can be selected by appropriate adjustment of the pivot 29. Suitable take-off means is located beyond the roller box 19 and will be described hereafter.

A plurality of wires 34 are fed from respective stationary spools (not shown) through an adjustable steadying tube 33 to the rotating tube 16 and the roller box 19 to and through the take-off means and from there either directly to a storage spool (not shown) or through a thermoplastic extruder 22, or moulding machine, and a cooling bath (not shown) to said spool. Preferably, powered means for drawing the wires 34 through the bunching machine as well as the extruder 22 will be incorporated ahead of the storage spool. The take-off means may comprise any suitable device which will retain the twist in the wires 34 passing therethrough, and in one form comprises a series of offset pins 21 fixed on a rigid base 21A and each transverse to the path of the wires 34. Preferably, the pins 21 are equally spaced as are the rollers 20.

In operation, rotation of the roller box 19 of the bunching machine will cause twisting of the length of the wires 34 in the region 35 spanning the gap between the box 19 and the first of the pins 21 of the take-off means. This twist is retained in the wires 34 while they are drawn over the remaining pins 21 and either on to the storage spool (not shown) or through the extruder head 22 of the plastics extrusion apparatus. When reversal of rotation of the roller box 19 occurs the wires 34 are firstly untwisted over the region 35 spanning the box 19 and the first pin 21 and then twisted in the reverse direction. However, as the wires 34 are continuously drawn through the machine there will be a short length between the adjacent portions of oppositely handed twists which will not be twisted at all while each twisted portion towards its ends will be less twisted than towards its centre. Nevertheless, the length of such parts can be kept within suitable limits by balance between firstly the distance of region 35 i.e. the spacing between the box 19 and the first pin 21, secondly the speed of rotation of the roller box 19, and thirdly the linear speed at which the wires 34 are drawn through the bunching machine. It has been found in practice that the alternate twisting of the wires 34 can be retained even when taken up upon a storage spool. Full advantage of the invention is obtained, however, when the alternately twisted wires 36 depart from the take-off means and almost immediately are introduced through a plastics extruder 22. Due to the high rate of rotation possible at the roller box 19, of the order of 5,000 r.p.m., the extruder 22 can be operated at close to its optimum extrusion capacity. Some care will be required to ensure that the supply of wires 34 to the roller box 19 is over a substantial length, in the order of at least 10 feet, which is free to twist with rotation of the box 19. No permanent twist will be imposed on the wires 34 behind the box 19 as the twist will be of low order per unit length.

An electric cable produced by the foregoing method, and especially employing the bunching machine described, has been found to have a similar external appearance to electric cables produced with the aid of a conventional bunching machine. It appears to be of substantial uniform cross-sectional shape throughout its length with the short untwisted portions between those of oppositely handed twists being not readily detectable.

It should be understood that besides the preferred embodiment incorporating those modifications referred to above other forms are possible within the scope of this invention.

What I claim is:

1. A bunching machine for producing from plural wires drawn along a path through said machine a power cable composed of plural twisted wires within an insulating casing, said machine comprising a tubular sleeve rotatable in bearings and surrounding part of said path; a twisting head on said sleeve including in said path a series of transversely disposed gripping rollers between which said path extends; stationary take-off means including in said path a series of transversely disposed twist retaining means for retaining the twist in the wires between which means said path extends whereby twisting together of said wires occurs between said head and said take-off means upon rotation of said sleeve; a reversible motor for rotating said sleeve in alternating directions to impart alternate sections of oppositely handed twists to the cable produced; a rotatable cam; driving means coupling said cam to said reversible motor; an electrical reversing switch controlling said motor operated by said cam to determine the degree of twist in each said section of said cable and a plastics coating machine in said path beyond said take-off means.

2. A bunching machine according to claim 1, further comprising an adjustable follower-actuator between said cam and said reversing switch for selective variation of said degree of twist in each said section of said cable.

3. A bunching machine according to claim 1, wherein said driving means includes step-down gearing from said motor.

4. A bunching machine according to claim 1, 2 or 3, wherein said twist retaining means are gripping pins.

5. A bunching machine according to claim 1, 2 or 3, wherein said gripping rollers and said twist retaining means of each of said series are arranged in a staggered offset sequence.

* * * * *